US006309477B1

(12) United States Patent
Shimakura et al.

(10) Patent No.: US 6,309,477 B1
(45) Date of Patent: Oct. 30, 2001

(54) NON-CHROMIUM PRETREATMENT CHEMICALS

(75) Inventors: Toshiaki Shimakura, Chiba-ken; Yutaka Wada; Takayuki Fukuoka, both of Osaka-fu, all of (JP)

(73) Assignee: Nippon Paint Co., Ltd., Osaka (JP)

( * ) Notice: Subject to any disclaimer, the term of this patent is extended or adjusted under 35 U.S.C. 154(b) by 0 days.

(21) Appl. No.: 09/373,647

(22) Filed: Aug. 13, 1999

(30) Foreign Application Priority Data

| | | |
|---|---|---|
| Aug. 13, 1998 | (JP) | 10-228911 |
| Jul. 8, 1999 | (JP) | 11-194514 |
| Jul. 23, 1999 | (JP) | 11-209012 |

(51) Int. Cl.[7] ..... C23C 22/07

(52) U.S. Cl. ..... 148/253; 148/255; 148/270; 148/279; 106/14.12; 252/389.2

(58) Field of Search ..... 148/253, 255, 148/270, 279; 106/141.12; 252/389.2

(56) References Cited

U.S. PATENT DOCUMENTS

| | | | |
|---|---|---|---|
| 2,762,733 | 9/1956 | Borghetti et al. | 148/6.17 |
| 3,922,389 | 11/1975 | Toledo et al. | 427/130 |
| 4,298,405 | 11/1981 | Saus et al. | 148/6.15 R |
| 4,331,487 | 5/1982 | Mirra et al. | 148/6.15 R |
| 5,969,019 * | 10/1999 | Kanai et al. | 524/140 |

FOREIGN PATENT DOCUMENTS

| | | |
|---|---|---|
| 1911972 | 10/1970 | (DE) . |
| 0363200 | 4/1990 | (EP) . |
| 0760401 | 3/1997 | (EP) . |
| 0853105 | 7/1998 | (EP) . |
| 1065191 | 5/1954 | (FR) . |
| 2272192 | 12/1975 | (FR) . |
| 2032963 | 5/1980 | (GB) . |
| 91/11542 | 8/1991 | (WO) . |

OTHER PUBLICATIONS

Patent Abstracts of Japan, vol. 1998, No. 12, Oct. 31, 1998 & JP 10 183366 A (Nippon Parkerizing Co Ltd; Toyota Motor Corp), Jul. 14, 1998.

Patent Abstracts of Japan, vol. 012, No. 283 (C–518), Aug. 3, 1988 & JP 63 060288 A (Sanko Kagaku KK; Others: 01), Mar. 16, 1988.

Patent Abstracts of Japan, vol. 005, No. 016 (C–041), Jan. 30, 1981 & JP 55 141575 A (Toshiba Corp), Nov. 5, 1980.

Keping et al, "A Protective Coating of Silicate On ZInc-plate", Materials And Corrosion 48, 110–112 (1997) (No month data available).

* cited by examiner

*Primary Examiner*—John Sheehan
*Assistant Examiner*—Andrew L. Oltmans
(74) *Attorney, Agent, or Firm*—Wenderoth, Lind & Ponack, L.L.P.

(57) ABSTRACT

The present invention is relates to pretreatment chemicals metal materials to be painted containing at least one kind of sulfur-containing compounds and at least one of phosphorus ion-containing compounds, and an anticorrosive treatment of metal materials, by the pretreatment chemicals.

6 Claims, No Drawings

NON-CHROMIUM PRETREATMENT CHEMICALS

BACKGROUND OF THE INVENTION

The present invention relates to pretreatment chemicals for metal materials to be painted. The metal materials include a steel plated with a metal (referred to as a metal-plated steel hereinafter), a non-plated steel or a metal other than steel. The present invention particularly relates to non-chromium pretreatment chemicals for metal materials to be painted, a metal-plated steel or a non-plated steel used as building materials or electrical household appliances in which a severe processing such as press or bending is needed after being painted, a method for pretreatment and a metal material treated thereby.

As the pretreatment chemicals used in the pretreatment for painting mentioned above, a reaction type or a coating type chromate-containing treating agent have been usually used. For example, a treating method where after the chromate treating agents are coated, an aqueous solution of an organic polymer resin is applied is disclosed in Japanese Patent Application KOKAI No.202084/1987. But considering the nowadays tendency of environmental regulation, there is the possibility such chromate-containing anticorrosive agent is restricted in use because of the high toxicity and the carcinogenicity. In this situation, Japanese Publication No.31593/1984 discloses a method of treating a metal surface without chromium. This method basically relates to a formation of phosphoric acid conversion film, which is insufficient for achieving a high adhesion of the painted film in the use of tough bending processing. An anticorrosive agent disclosed in Japanese Patent Application No.195244/1993 is not a perfect pollution-free treating agent, as it contains fluorine ion and heavy metal, and it is far from an ideal non-chromium treating agent in view of the high load in waste water treatment.

SUMMARY OF THE INVENTION

The present invention relates to pretreatment chemicals for metal materials to be painted with paints and a pretreatment using the same, by which an excellent adhesion between the painted film and the undersurface of the metal materials (this adhesion of the painted film is expressed by term "formability"), especially high resistance against bending and scratching can be achieved.

The present invention relates to pretreatment chemicals for metal materials to be painted, which comprise at least one of sulfur-containing compounds and at least one of phosphorus ion-containing compounds (phosphorus ion means acid ions containing at least one of a phosphorus atom) in water.

Further, the present invention relates to an anticorrosive treatment comprising treating metal materials with said pretreatment chemicals.

Additionally the present invention relates to metal materials treated with said pretreatment chemicals.

DETAILED DESCRIPTION OF THE INVENTION

The present invention relates to pretreatment chemicals for metal materials to be painted (simply referred to as "pretreatment chemicals" hereinafter) which comprises at least one of sulfur-containing compounds and at least one of phosphorus ion-containing compounds in water.

In the present specification the term "metal materials" means a sheet, a plate, a processed product or the like which is made of metal such as steel, zinc, aluminum, copper and the like; steel plated with metal such as Zn, Al, Ni, Cr, Sn, Pb, Fe, Co, Mg, Mn, Ti and the like; alloys made of at least two kinds of metals; steel alloyed with at least one of the above metals and in some cases hetero atoms or other impurities on the surface; metals such as steel in which an oxide such as silica, titania, alumina and the like or other elements such as carbon, silicon and the like are dispersed; non-plated metal such as non-plated steel and the like.

Typical examples of the metal materials are zinc-plated steel, aluminum-plated steel or non-plated steel, particularly zinc-plated steel.

The term "plating" or "plated" includes an electro-galvanizing, a fused metal plating, a deposition, an injection and the like.

The metal materials are treated with an aqueous solution comprising one or more sulfur-containing compounds selected from the group consisting of sulfides, triazinethiols, thiocarbonyl group-containing compounds, thiosulfuric acid, thiosulfates, persulfuric acid, and persulfates in the amount of 0.1 g–50 g and one or more compounds containing phosphorus ions (referred to as "phosphorus ion-containing compounds" hereinafter) which contain ions selected from the group consisting of phosphate ion, phosphite ion, hypophosphite ion, condensed phosphate ions, phytate ion, phosphonate ion in the amount of 0.1 g–50 g per one liter of the total amount of the pretreatment chemicals.

In the present invention, the working mechanism of the sulfur-containing compounds and phosphorus ion-containing compounds has not been clarified, but it is inferred as follows.

A sulfide ion reacts with a metal surface to form a metal sulfide. For example, zinc sulfide is one of the most stable compounds among the zinc compounds as is clear from the last that zinc sulfide naturally exists as sphalerite. Therefore, it is considered the corrosion resistance and formability of the paint are improved by the formation of the film of zinc sulfide on the zinc-plated surface. At this moment as there are phosphorus ion-containing compounds, the corrosion resistance and formability of the paint is further improved as multiplier effect but the reason is not clear.

In the case of the other sulfur-containing compounds, an absorbed layer of the sulfur-containing compounds are also formed owing to easy absorbency of a sulfur atom to metal materials, especially zinc surface, and therefore the corrosion resistance and the formability of a paint are improved. At this moment if there is a phosphorus ion-containing compound, the corrosion resistance and the formability of paint are further improved as multiplier effect but the reason is not clear. Sulfur-containing compounds or phosphorus ion-containing compounds can lower only cathode current of metal materials, but when both of them exist at the same time, both of the anode current and the cathode current lower so as to improve the corrosion resistance and the formability of paint.

Examples of the sulfur-containing compounds useful in the present invention include sulfides, triazinethiol compounds, thiocarbonyl group-containing compounds, thiosulfuric acid, thiosulfates, persulfuric acid persulfates.

Any sulfides which can release a sulfide ion in an aqueous solution may be used. Examples of such sulfides include sodium sulfide, ammonium sulfide, manganese sulfide, molybdenum sulfide, iron sulfide, barium sulfide and like. Sulfide ion is formed in pretreatment chemicals by the addition of the sulfides which can release a sulfide ion in an aqueous solution.

The examples of triazinethiol compounds include 2,4,6-trimercapto-S-triazine, 2-dibutylamino-4,6-dimercapto-S-triazine, monosodium 2,4,6-trimercapto-S-triazine, trisodium 2,4,6-trimercapto-S-triazine, 2-anilino-4,6-dimercapto-S-triazine, monosodium 2-anilino-4,6-dimercapto-S-triazine.

Examples of the thiocarbonyl group-containing compounds include thiourea, dimethylthiourea, 1,3-diethylthiourea, dipropylthiourea, dibutylthiourea, 1,3-diphenyl-2-thiourea, 2,2-ditolylthiourea, thioacetamide, sodium dimethyldithiocarbamate, tetramethylthiuram monosulfide, tetrabutylthiuram disulfide, zinc N-ethyl-N-phenyl-dithiocarbamate, zinc dimethylthiocarbamate, piperidine pentamethylenedithiocarbamate, zinc diethyldithiocarbamate, sodium diethyldithiocarbamate, zinc isopropylxanthate, ethylene thiourea, dimethylxanthatedisulfide, dithiooxamide and like. They should only be the compounds having at least one thiocarbonyl group.

A thiosulfate ion can be formed in pretreatment chemicals by adding a compound which can release thiosulfate ion in an aqueous solution. Such compounds should only be ones which can release thiosulfate ion in an aqueous solution and examples of such compounds include thiosulfuric acid, ammonium thiosulfate, sodium thiosulfate, potassium thiosulfate and the like.

A persulfate ion can be formed in pretreatment chemicals by adding a compound which can release persulfate ion in an aqueous solution. Such compounds should only be ones that can release persulfate ion in an aqueous solution. Examples of such compounds include persulfuric acid, ammonium persulfate, sodium persulfate, potassium persulfate, and the like.

In the present invention, at least one of the above sulfur-containing compounds are contained in the pretreatment chemicals of the present invention.

Triazinethiols and thiocarbonyl group-containing compounds among them are particularly preferable in the aspect of the stability.

A phosphorus ion useful for the present invention is preferably phosphate ion, phosphite ion, hypophosphite ion, condensed phosphate ion, phytate ion and phosphonate ion.

A compound which can release phosphate ion in pretreatment chemicals according to the present invention should only be compounds which can release phosphate ion in an aqueous solution, and examples of such compounds include phosphoric acid; ammonium salts of phosphoric acid such as triammonium phosphate, diammonium hydrogenphosphate, ammonium dihydrogenphosphate; alkaline metal salts of phosphoric acid such as trisodium phosphate, disodium hydrogenphosphate, sodium dihydrogenphosphate, tripotassium phosphate; alkaline earth metal salts of phosphoric acid such as zinc phosphate, calcium phosphate, magnesium phosphate; iron phosphate, manganese phosphate, phosphomolybdic acid, and the like.

A compound which can release phosphite ion should only be compounds which can release phosphite ion in an aqueous solution, and examples of such compounds include phosphorous acid, ammonium phosphite, sodium phosphite, potassium phosphite, and the like.

A compound which can release hypophosphite ion should only be compounds which can release hypophosphite ion in an aqueous solution and examples of such compounds include hypophosphorous acid, ammonium hypophosphite, sodium hypophosphite, potassium hypophosphite, and the like.

A condensed phosphate ion is preferably polyphosphate ion, pyrophosphate ion, metaphosphate ion, ultraphosphate ion. Examples of compounds which can release a condensed phosphate ion in an aqueous solution include condensed phosphoric acids such as polyphosphoric acid, pyrophosphoric acid, metaphosphoric acid, ultraphosphoric acid and ammonium salts, alkaline metal salts and alkaline earth metal salts thereof, and the like.

Examples of the compounds which can release phytate ion include phytic acid, ammonium phytate salt and alkaline metal salts thereof, and the like.

Examples of the compounds which can release phosphonate ion include phosphonic acid or ammonium salt, alkaline metal salts thereof such as aminotri(methylene phosphonate), 1-hydroxyethylydene-1,1-diphosphate, ethylenediaminetetra(methylene phosphonate), diethylenetriaminepenta(methylene phosphonate) and the like.

The most preferable phosphorus ion is phosphate ion, condensed phosphate ion, phytate ion or phosphonate ion. One or more of such phosphorus ions are preferably contained in the pretreatment chemicals for painting.

Sulfur-containing compounds and phosphorus ion-containing compounds are each contained in the pretreatment chemicals preferably in the amount of 0.1–50 g, more preferably 0.5 g–10 g in one liter of the pretreatment chemicals. When either concentration thereof is lower than 0.1 g/l, the corrosion resistance and the formability of paint become lower. And when either the amount thereof is higher than 50 g/l, these properties become plateau and therefore become uneconomical.

An anticorrosive additive may be optionally added together with above sulfur-containing compounds and phosphorus ion-containing compounds to the pretreatment chemicals according to the present invention. As anticorrosive additives water-dispersible silica and the like are exemplified.

By the addition of the water-dispersible silica into the pretreatment chemicals of the present invention, the drying ability, formability of the paint film and corrosion resistance can be improved. A water dispersible silica aforementioned is not particularly restricted so far as it contains little amount of impurities such as sodium and the like and it shows a weak alkalinity. Commercially available silica gels such as "Snowtex N", "Snowtex UP", "Snowtex PS" (these are manufactured by Nissan Kagaku Kogyo K.K.), "Adelite AT-20N" (manufactured by Asahi Denka Kogyo K.K.) and the like as the colloidal silica, or commercially available Aerosil (by Nippon Aerosil K.K.) as the fumed silica, silica particles and the like are usable. Among them, as the water dispersible silica which can improve the formability of the painted film such as scratching resistance, "Snowtex PS" which is a bulk of huge silica (particle size 10–50 nm) as the aggregation of spherical colloidal silica and is commercially available by the name "pearls-like colloidal silica" or fumed silica commercially available as "Aerosil" is exemplified.

The content of the water dispersible silica is preferably 1–500 g and particularly preferably 5–250 g in 1 liter of the pretreatment chemicals.

When the amount of the water dispersible silica is less than 1 g/l, satisfactory anticorrosive effect may not be obtained, and when it is more than 500 g/l, the property is not improved any more and therefore it is uneconomical.

The pretreatment chemicals according to the present invention may contain other components. For example, silane coupling agents, surfactants and like may be incorporated. Silane coupling agents may improve the formability of the paint film painted on the metal materials treated with the pretreatment chemicals.

Silane coupling agents as aforementioned may be, for example, γ-aminopropyltrimethoxysilane, γ-aminopropyltriethoxysilane, γ-glycidoxypropyltrimethoxysilane, γ-methacryloxypropyltriethoxysilane, N-[2-(vinylbenzylamino)ethyl]-3-aminopropyltrimethoxysilane and the like.

The pretreatment chemicals according to the present invention may be prepared by mixing the abovementioned components with water with stirring by a usual manner. The treating agent obtained thus should not be too acidic nor too basic, especially, in case that the metal materials are zinc or aluminal. Therefore its pH value is preferably adjusted to 2–12, more preferably 4–10.

The pretreatment chemicals according to the present invention are typically used as pretreatment chemicals for zinc-plated steel.

Such pretreatment may be accomplished by drying the metal materials at a room temperature or with hot air after the pretreatment chemicals are applied thereon or in an alternative process, by pre-heating the metal materials to be painted followed by applying the pretreatment chemicals on the hot metal materials, and then drying them by the residual heat in the metal materials.

The above drying temperature may be a room temperature to 250° C. in either process described above. When the drying temperature is lower than room temperature, the evaporation speed of water is too slow to achieve sufficient film formation, so that it is uneconomical. On the other hand, when the drying temperature is higher than 250° C., the heat decomposition of the sulfur-containing compounds may occur. Therefore, preferable drying temperature is 50° C. to 180° C. In case that the metal materials are dried with hot air after application of the pretreatment chemicals, the drying period is preferably 1 second to 10 minutes.

In the pretreatment described above, the thickness of the coated film of the pretreatment chemicals is preferably not less than 5 mg/m$^2$ (dry weight of the treating agent/surface area of metal materials) dried. A thickness less than 5 mg/m$^2$ causes deficiency in the anticorrosion ability. On the other hand an excess thickness of the film is economically disadvantageous as an undercoating and inconvenient for the application. Accordingly, a film thickness of 10 to 1000 mg/m$^2$ is more preferable, and 10 to 500 mg/m$^2$ thickness is most preferable.

In the present invention the method for applying the pretreatment chemicals is not particularly restricted so far as the treating agent contacts metal materials to be treated, and the usual process such as roll coating, air spraying, airless spraying, flow coating, dipping and the like may be used.

Metal materials, especially zinc-plated steel sheet treated with the pretreatment chemicals of the present invention exhibit remarkable reduction in the anode current density and cathode current density in the direct current polarizing test in comparison with non-treated metal materials, and shows the same or higher corrosion resistance than usual metal plated materials treated with a chromate-containing treating agent. This means that an anticorrosively excellent film of a sulfur-containing compound and a phosphorus ion-containing compound is formed on the surface of the metal materials. Metal materials which were treated with pretreatment chemicals and painted with a paint have the same or more excellent resistances against bending, scratching, and salt spraying in comparison with metal materials treated with a conventional chromate-containing treating agent.

Metal materials to be treated with the pretreatment chemicals according to the present invention include metal-plated steel, preferably zinc-plated steel or non-plated steel as described above.

The present invention is illustrated by the Examples and Comparative Examples, but it should not be construed that the present invention is restricted by these examples.

EXAMPLE 1

Sodium sulfide (2.5 g) and $(NH_4)_2HPO_4$ (2.5 g) are dissolved in pure water (1 l), and the pH value of the solution was adjusted to 10.5 with NaOH to give pretreatment chemicals.

On the other hand, commercially available electro-zinc-plated steel sheet "EG-MO" (manufactured by Nippon Test Panel CO. LTD.; 300×210×0.8 mm) was degreased by an alkali cleaner "Surfcleaner 155" (manufactured by NIPPON PAINT CO., LTD.) at 65° C. for 2 minutes and washed by water and then by pure water, followed by dried at 80° C. The pretreatment chemicals prepared above were coated on the above zinc-plated steel by #5 of bar coater with the film weight of 100 mg (dry weight)/m$^2$ (steel surface), and was dried at 120° C. for 2 minutes. A primer "Flekicoat 600 primer" (manufactured by NIPPON PAINT CO., LTD.) was painted with the coating amount of 5 g/m$^2$ in dry on the electro-zinc-plated steel sheet treated with the pretreatment chemicals and was dried at the metal surface temperature of 215° C. And then, a top coat "Flekicoat 5030" (manufactured by NIPPON PAINT CO., LTD.; polyester based paint) was painted there on with the painting amount of 29 g/m$^2$ in dry and dried at a metal surface temperature of 230° C. to give a painted zinc-plated steel sheet.

EXAMPLES 2–12

An pretreated electro-zinc-plated steel sheet is prepared in the same way as Example 1 except that the kind and the addition amount of sulfur-containing compounds, the kind and the addition amount of the phosphorus ion-containing compounds in the pretreatment chemicals and the pH value of the pretreatment chemicals were changed according to Table 1, and eventually painted zinc-plated steel sheets were obtained.

Comparative Example 1

A chromate/resin-containing pretreatment chemicals was coated with the coated amount of 40 mg/$^2$ as chromium using bar coater #3 on the same kind of electro-zinc-plated steel sheet as used in Example 1, and washed in the same way as in Example 1. The coated steel sheet was dried for 1 minute at 80° C. to give pretreated zinc steel sheet. This pretreated steel sheet was painted with the primer and top paints in the same way as Example 1 to give a painted zinc-plated steel sheet.

Comparative Examples 2 and 3

An undersurface-treated electro-zinc-plated steel is prepared in the same way as Example 1 except that the kind and addition amount of the sulfur-containing compounds, the kind and addition amount of the phosphorus ion-containing compounds in the pretreatment chemicals and the pH value of the pretreatment chemicals were changed according to Table 1, and eventually a painted zinc-plated steel sheet was obtained.

The formability of the painted film and salt spray test of the painted zinc-plated steel sheets obtained in Examples 1–12 and Comparative Examples 1–3 were conducted according to following methods. The results were shown in Table 1.

TABLE 1

| | | sulfur-containing compound | | phosphorus ion-containing compound | | | Formability Test#1 | | |
|---|---|---|---|---|---|---|---|---|---|
| | | compound | amount#2 | compound | amount#2 | pH | bending test | coin scratching | SST#1 |
| Example | 1 | sodium sulfide | 2.5 | $(NH_4)_2HPO_4$ | 2.5 | 10.5 | 5 | 5 | 5 |
| | 2 | manganese sulfide | 0.15 | $H_3PO_4$ | 0.15 | 2.5 | 4 | 4 | 4 |
| | 3 | thiourea | 50 | $(NH_4)_3PO_4$ | 50 | 8.5 | 5 | 5 | 5 |
| | 4 | 1,3-diethyl-2-thiourea | 10 | $Na_2HPO_4$ | 5.0 | 8.5 | 5 | 5 | 5 |
| | 5 | tributyl thiourea | 5.0 | Na phytate | 5.0 | 8.0 | 5 | 5 | 5 |
| | 6 | sodium dibutylthio carbamate | 5.0 | $H_3PO_4$ | 2.5 | 3.5 | 5 | 5 | 5 |
| | 7 | 2,4,6-trimercapto -S-triazine | 1.0 | $Na_3PO_4$ | 1.0 | 11.5 | 5 | 5 | 5 |
| | 8 | sodium 2,4,6-tri mercapto-S-triazine | 2.5 | $H_3PO_4$ | 1.0 | 5.0 | 5 | 5 | 5 |
| | 9 | trisodium 2,4,6-tri mercapto-S-triazine | 5.0 | HEDP1) | 2.5 | 3.5 | 4 | 5 | 5 |
| | 10 | 2-anilino-4,6-dimercaptp-S-triazine | 5.0 | HEDP3Na | 2.5 | 8.5 | 4 | 4 | 5 |
| | 11 | ammoniumu thiosulfate | 5.0 | $(NH_4)_2HPO_4$ | 5.0 | 8.5 | 5 | 5 | 5 |
| | 12 | ammonium persulfate | 5.0 | $(NH_4)_2HPO_4$ | 5. 0 | 8.5 | 5 | 5 | 5 |
| Com. Ex | 1 | treatment by coating type chromate (amount of chromium attached:40 mg/m$^2$) | | | | | 3 | 3 | 4 |
| | 2 | sodium sulfide | 0.05 | $(NH_4)_2HPO_4$ | 0.05 | 8.5 | 2 | 2 | 2 |
| | 3 | ammonium thiosulfate | 0.05 | $Na_2HPO_4$ | 0.01 | 8.5 | 1 | 2 | 2 |

1)1-hydroxyethylidene-1,1-disulfonate,
#1after Top coating,
#2Unit is g/l.

Evaluation Method

1) Formability Test by bending:

A painted electro-zinc-plated steel sheet is cut into a 5 cm×3 cm piece and it is bent by a pneumatic vise, and then the bent area is subjected to a tape peeling test. The result of peeling is estimated.

The evaluation criteria is as follows:

Point 5: No stripping and no crack is observed.

Point 4: No stripping, but cracks are observed.

Point 3: A very little stripping is observed.

Point 2: A little stripping is observed.

Point 1: Distinct stripping is observed.

2) Formability test by coin scratching:

The surface of a painted eletro-zinc-plated steel sheet is scratched by a ten yen coin applying a pressure of 1 kg/cm$^2$ using a scratching tester. The degree of peeling is evaluated.

The evaluation criteria is as follows:

Point 5: The exposure of the primer is less than 10%.

Point 4: The exposure of the primer is 10–70%. Any exposure of the substrate is not observed.

Point 3: The exposure of the primer is more than 70%, the exposure of the substrate is less than 30%.

Point 2: The exposure of the substrate is 30–70%.

Point 1: The exposure of the substrate is more than 70%.

3) Salt Spray Test (SST)

A cross-like notch is made on the surface of painted zinc-plated steel sheet with cutter and then the steel sheet is subjected to salt spray test for 1500 hours. The formability is evaluated by the inflated width in the cross cut area.

The evaluation criteria is as follows:

Point 5: Inflated width is 0 mm.

Point 4: Inflated width is 1 mm or less.

Point 3: Inflated width is 3 mm or less.

Point 2: Inflated width is 5 mm or less.

Point 1: Inflated width is more than 5 mm

EXAMPLES 13–15

As described in Table 2, pretreatment chemicals are prepared, and the coated electro-zinc-plated steel sheets are obtained in the same way as in Example 7 except that a water dispersible silica is further added.

The painted zinc-plated steel sheets obtained in Examples 7, 13–15 and Comparative Examples 1–3 are evaluated on the formability of the pained film, and the salt spray test using the method of Testing 1') and 2') and the criteria of the estimation described below. The results are shown in Table 2.

1) The Formability Test by Bending

A painted electro-zinc-plated steel sheet is cut into a 5 cm×3 cm piece and it is bent by a pneumatic vise, and then the bent area is subjected to a tape peeling test. The results of peeling is estimated.

OTT: Bending is conducted without interposing anything.

1TT: Bending is conducted with 1 sheet of the same kind of steel sheet inside bending.

2TT: Bending is conducted with 2 sheets of the same kind of steel sheet inside bending.

The evaluation criteria is as follows:

Point 5: No stripping and no crack is observed.

Point 4: No stripping, but the crack is observed.

Point 3: A very little stripping is observed.

Point 2: A little stripping is observed.

Point 1: Distinct stripping is observed.

2') Formability Test by Coin Scratching

The surface of the painted electro-zinc-plated steel sheet is scratched by a ten yen coin as applying pressure of 2 kg/cm$^2$ using a scratching tester. The degree of the peeling is evaluated.

The evaluation criteria is as follows:

Point 5: The exposure of the primer is less than 10%.

Point 4: The exposure of the primer is 10–70%. Any exposure of the substrate is not observed.

Point 3: The exposure of the primer is more than 70%, the exposure of the substrate is less than 30%.

Point 2: The exposure of the substrate is 30–70%.

Point 1: The exposure of the substrate is more than 70%.

TABLE 2

| | | sulfur-containing compound | | phosphorus ion-containing compound | | water dispersible silica | | Formability Test by bending | | | coin |
|---|---|---|---|---|---|---|---|---|---|---|---|
| | | compound | amount #2 | compound | amount #2 | compound | amount | OTT | 1TT | 2TT | scratching |
| Example | 7 | 2,4,6-tri mercapto-S -triazine | 1.0 | $Na_3PO_4$ | 1.0 | — | — | 4 | 4.5 | 5 | 3 |
| | 13 | 2,4,6-tri mercapto-S -triazine | 1.0 | $Na_3PO_4$ | 1.0 | Snowtex -N | 50 | 4 | 4.5 | 5 | 5 |
| | 14 | 2,4,6-tri mercapto-S -triazine | 1.0 | $Na_3PO_4$ | 1.0 | Snowtex -PS | 50 | 4 | 4.5 | 5 | 5 |
| | 15 | 2,4,6-tri mercapto-S -triazine | 1.0 | $Na_3PO_4$ | 1.0 | Aerosil 200 | 50 | 4 | 4.5 | 5 | 5 |
| Com. Example | 1 | treatment by coating type chromate (amount of chromium attached:40 mg/m$^2$) | | | | | | 3 | 4 | 5 | 2 |
| | 2 | sodium sulfide | 0.05 | $(NH_4)_2HPO_4$ | 0.05 | — | — | 2 | 3 | 3 | 2 |
| | 3 | ammonium thiosulfate | 0.05 | $Na_2HPO_4$ | 0.01 | — | — | 1 | 2 | 3 | 2 |

#2) Unit is g/l.

The pretreatment chemicals according to the present invention have an excellent performance, particularly as pretreatment chemicals for a zinc-plated steel sheet, and the zinc-plated steel sheet which is painted after the pretreatment above maintains the good formability of painted film and durability even after applying a severe processing such as bending.

What is claimed is:

1. A pretreatment composition for metal materials to be painted, which consists of:

0.1 to 50 g of at least one of sulphur-containing compounds selected from the group consisting of sulfides, triazinethiols, thiocarbonyl group-containing compounds, thiosulfuric acid, thiosulfates, persulfuric acid, and persulfates, 0.1 to 50 g of at least one of phosphorus ion-containing compounds selected from the group consisting of phosphate ion, phosphite ion, hypophosphite ion, condensed phosphate ions, phytate ion, and phosphonate ion, 1 to 500 g of an anticorrosion additive, and the rest water, in one liter of the pretreatment composition, wherein the pH of the composition is adjusted to 2 to 12.

2. The composition of claim 1, in which the amount of sulfur-containing compounds is 0.5 g to 10 g and the amount of the phosphorus ion-containing compounds is 0.5 to 10 g in one liter of the composition.

3. The composition of claim 1, in which the metal materials are selected from the group consisting of zinc-plated steel, aluminum-plated steel and non-plated steel.

4. A pretreatment composition for metal materials to be painted, which consists of:

0.1 to 50 g of at least one of sulphur-containing compounds selected from the group consisting of sulfides, triazinethiols, thiocarbonyl group-containing compounds, thiosulfuric acid, thiosulfates, persulfuric acid, and persulfates, 0.1 to 50 g of at least one of phosphorus ion-containing compounds selected from the group consisting of phosphate ion, phosphite ion, hypophosphite ion, condensed phosphate ions, phytate ion, and phosphonate ion, 1 to 500 g of water-dispersible silica, and the rest water, in one liter of the pretreatment composition, wherein the pH of the composition is adjusted to 2 to 12.

5. The composition of claim 4, in which the amount of sulfur-containing compounds is 0.5 g to 10 g and the amount of the phosphorus ion-containing compounds is 0.5 g to 10 g in one liter of the composition.

6. The composition of claim 4, in which the metal materials are selected from the group consisting of zinc-plated steel, aluminum-plated steel and non-plated steel.

* * * * *